US011141874B2

(12) United States Patent
Osawa et al.

(10) Patent No.: US 11,141,874 B2
(45) Date of Patent: Oct. 12, 2021

(54) ELECTRIC-POWER-DRIVEN WORKING DEVICE

(71) Applicant: Yamabiko Corporation, Tokyo (JP)

(72) Inventors: Hisato Osawa, Tokyo (JP); Atsushi Nishimura, Tokyo (JP); Kenji Nakano, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 8 days.

(21) Appl. No.: 16/742,461

(22) Filed: Jan. 14, 2020

(65) Prior Publication Data

US 2020/0223090 A1 Jul. 16, 2020

(30) Foreign Application Priority Data

Jan. 15, 2019 (JP) ..... JP2019-004272

(51) Int. Cl.
*B27B 5/29* (2006.01)
*B27B 19/00* (2006.01)

(52) U.S. Cl.
CPC ..... *B27B 5/29* (2013.01); *B27B 19/002* (2013.01)

(58) Field of Classification Search
CPC ..... B27B 5/29; B27B 19/002; B27B 17/08; B27B 17/0008; B27B 17/00; B27B 17/02; B27B 17/12; B27B 17/14; B27F 5/02; B27F 5/026; A01G 3/086
USPC ..... 30/371, 381–387, 296.1; 173/162.1, 173/162.2; 429/529, 500, 680
See application file for complete search history.

(56) References Cited

U.S. PATENT DOCUMENTS 5,570,512 A * 11/1996 Hoppner ..... B27B 17/0008 30/381
5,902,080 A * 5/1999 Kopras ..... B25F 5/029 409/182
7,547,167 B2 * 6/2009 Baber ..... B25F 5/029 409/182

(Continued)

FOREIGN PATENT DOCUMENTS

EP 1952959 A1 8/2008
EP 2239103 A1 10/2010

(Continued)

OTHER PUBLICATIONS

Extended European Search Report for International Application No. 20151115.1, dated Jun. 24, 2020; date of filing: Jan. 10, 2020; 7 pages.

*Primary Examiner* — Ghassem Alie
(74) *Attorney, Agent, or Firm* — Grumbles Law PLLC; Brittany Nanzig

(57) ABSTRACT

A chainsaw 1 (electric-power-driven working device) comprises a body case 10, a cutting attachment 20 (work tool), a motor 30 and a battery 90. A front portion 11*a* of the body case 10 houses the motor 30 and a battery mount-and-release portion 12 is formed on a rear portion 11*b* of the body case 10. The battery 90 mounted on the battery mount-and-release portion 12 extends in an upper-lower direction across and over a middle portion in a height direction of the rear portion 11*b* of the body case 10. The side handle 50 arranged to a side face of the body case 10 extends from the front portion 11*a* to the rear portion 11*b* of the body case 10. A rear end portion 52 of the side handle is disposed rearward of and below an output shaft 31 of the motor 30.

6 Claims, 3 Drawing Sheets

(56) References Cited

U.S. PATENT DOCUMENTS

| | | | | |
|---|---|---|---|---|
| 8,528,217 | B2 * | 9/2013 | Kondo | B27B 17/00 30/296.1 |
| 2004/0049926 | A1 * | 3/2004 | Miklosz | B25F 5/02 30/391 |
| 2007/0240892 | A1 * | 10/2007 | Brotto | B27B 9/00 173/217 |
| 2009/0100688 | A1 * | 4/2009 | Sugishita | B27B 17/0008 30/381 |
| 2011/0078910 | A1 | 4/2011 | Tomita et al. | |
| 2014/0047722 | A1 * | 2/2014 | Onose | B25F 5/02 30/383 |
| 2017/0203462 | A1 | 7/2017 | Haneda et al. | |
| 2019/0111582 | A1 * | 4/2019 | Suzuki | B27B 17/08 |

FOREIGN PATENT DOCUMENTS

| | | | |
|---|---|---|---|
| EP | 2952306 | A1 | 9/2015 |
| JP | 5462575 | B2 | 4/2011 |

* cited by examiner

ELECTRIC-POWER-DRIVEN WORKING DEVICE

CROSS REFERENCE TO RELATED APPLICATIONS

This application claims the foreign priority benefit under 35 U.S.C. § 119 of Japanese Patent Application No. 2019-004272 filed on Jan. 15, 2019, the disclosure of which is incorporated herein by reference.

FIELD OF THE INVENTION

The present invention is related to an electric-power-driven working device.

BACKGROUND ART

There has been known a conventional electric-power-driven chainsaw with a motor housed in a body case, a battery mounted at a rear end portion and a side handle fixed to a side of the body case (For example, see JP5462575B2). A larger battery can be mounted to this type of the chainsaw, compared with a chainsaw having a body case housing a battery.

The conventional electric-power-driven chainsaw as mentioned above has a side handle disposed frontward of a motor. Since this type of chainsaw has the motor and the battery both disposed rearward of the side handle, it has a problem with its weight being balanced at a more rearward position when the side handle is gripped. However, if a smaller battery is mounted taking account of the weight balance, an output power of the chainsaw is decreased and its charge capacity is decreased as well, leading to a shorter operation time.

SUMMARY OF THE INVENTION

The present invention is intended to have an objective to solve the problem mentioned above to provide an electric-power-driven working device which is weight-balanced when a user holds a side handle and with which an intended operation is carried out easily.

In order to achieve the objective above mentioned, an electric-power-driven working device of the present invention comprises a body case, a work tool projecting frontward out of a front portion of the body case, a motor driving the work tool and a battery for supplying electric power to the motor. The front portion of the body case houses the motor while a battery mount-and-release portion, on which the battery is mounted and from which the battery is released, is formed at a rear portion of the body case. The battery mounted on the battery mount-and-release portion extends in an upper-lower direction and across a middle portion in a height direction of the rear portion of the body case. A side handle is arranged to a side face of the body case, extends from the front portion of the body case to the rear portion of the body case and has a rear end portion disposed rearward of and below an output shaft of the motor.

The electric-power-driven working device of the present invention includes a body, a work tool is disposed frontward of the body and a battery is disposed rearward of the body. The electric-power-driven working device includes the side handle extending rearward of and below an output shaft of the motor. According to this configuration, a weight of the electric-power-driven working device is well balanced in the front-rear direction when an operator holds the side handle during work, even if a larger battery is mounted on a rear portion of the electric-power-driven working device. In addition, the larger battery is held with the side handle gripped by the operator with his or her arms bent at an angle suited for holding. Accordingly, the configuration of the electric-power-driven working device of the present invention facilitates the operator holding the electric-power-driven working device during work.

According to the electric-power-driven working device of the present invention, the operator can work gripping a rear portion of the side handle to support a larger battery when the operator has to work with his or her arms stretched. As a result, it is easy for the operator to hold the electric-power-driven working device during work, which results in increasing the work efficiency.

DETAILED DESCRIPTION OF THE INVENTION

Hereinafter, an example of an embodiment of the present invention is explained in detail appropriately with reference to the attached figures. This embodiment shows a chainsaw to cut trees and wood plates to which the present invention is applied. In the description below, a front portion of the chainsaw is referred to as a cutting attachment portion of the chainsaw and an upper portion of the chainsaw is referred to as a top handle portion of the chainsaw.

Figure 1:
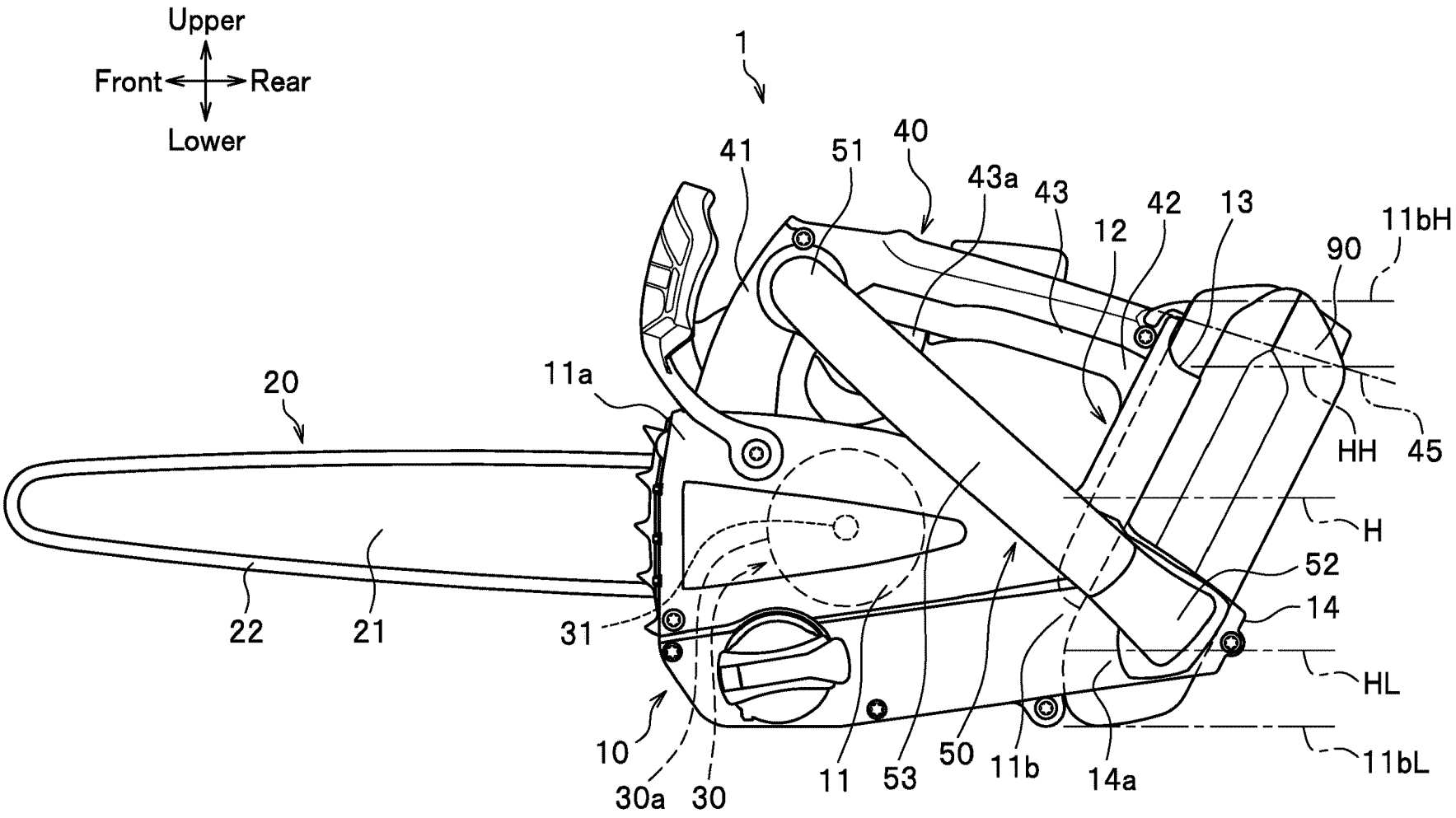
FIG. 1 is a side elevation view of a chainsaw in accordance with an embodiment of the present invention.

A chainsaw 1 as shown in FIG. 1 comprises a body case 10, a cutting attachment 20 attached to the body case 10, a motor 30 for driving the cutting attachment 20 and a battery 90. The cutting attachment 20 of the chainsaw 1 is driven by electric power supplied to the motor 30 from the battery 90 mounted at the body case 10.

The body case 10 comprises a body portion 11 that is a box shape body made of resin and a top handle 40 formed on an upper side of the body portion 11. Thus, the top handle 40 is formed on an upper portion of the body case 10. A side handle 50 is arranged and fixed on a left side face of the body case 10.

A motor 30 is housed in a front portion 11*a* of the body portion 11. A battery mount-and-release portion 12, on which a battery can be mounted and from which the battery is released, is formed at a rear portion 11*b* of the body portion 11.

The motor 30 is a known electric-power-driven motor. An output shaft 31 of the motor 30 extends in the right-left direction.

The body portion 11 has a front portion 11*a* that houses not only the motor 30 but also a control board (not shown) and drive mechanism parts such as a drive gear secured to an output shaft 31 of the motor 30.

The battery mount-and-release portion 12 is formed on a rear end face of the body portion 11. The battery mount-and-release portion 12 includes a retaining portion 13 to retain a battery 90 and a battery case 14 which receives a lower portion of the battery 90.

Figure 3:
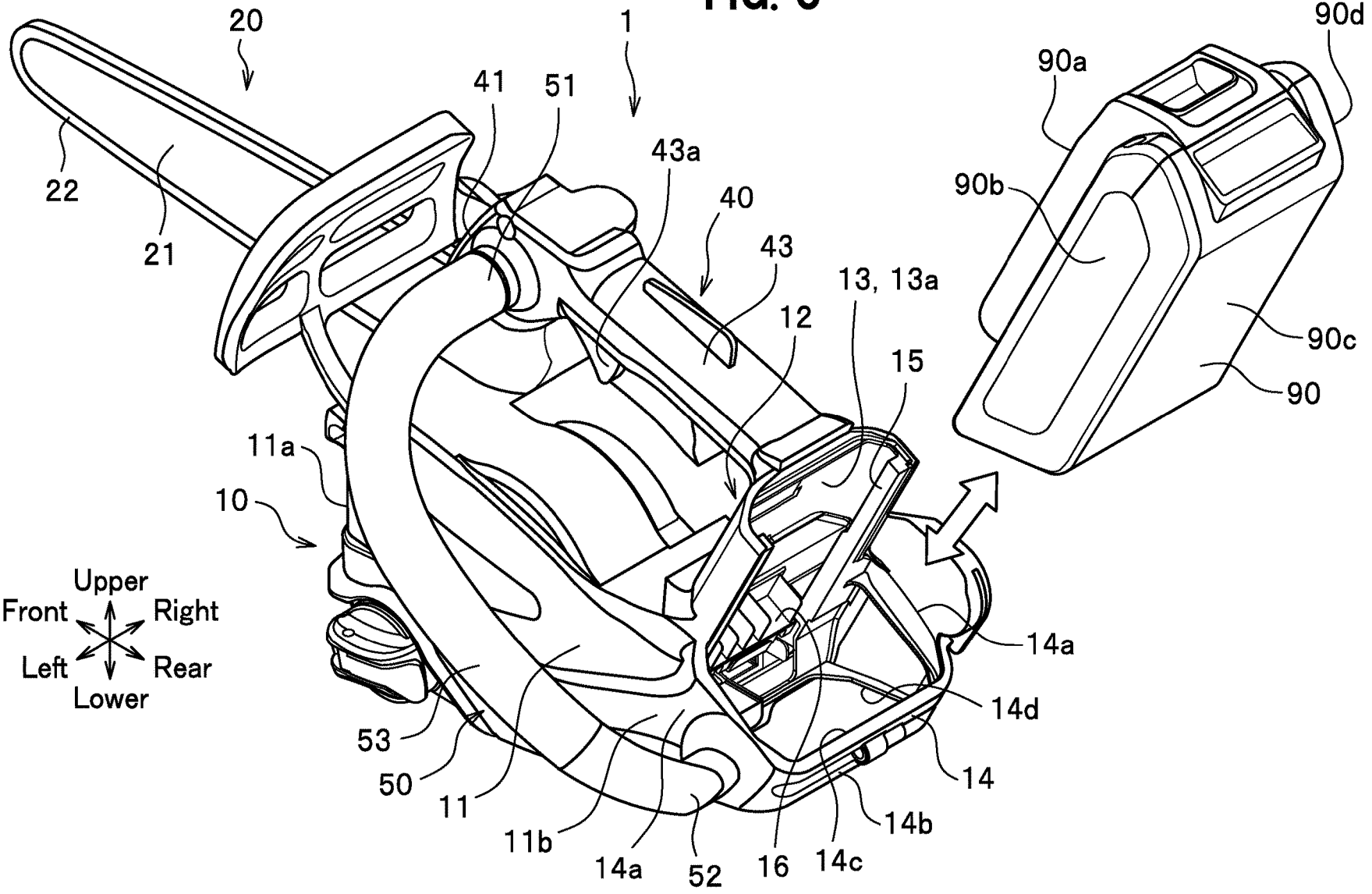
FIG. 3 is a perspective view of the chainsaw of the embodiment from which a battery is removed.

The retaining portion 13 is formed along a rear end portion of the body portion 11 and includes a plate-like portion extending upward on the rear end portion of the body portion 11. The retaining portion 13 inclines in such a way that a lower portion of the retaining portion 13 is positioned frontward of an upper portion of the retaining portion 13. As shown in FIG. 3, a rear face 13*a* of the retaining portion 13 is an inclined face such that the rear face 13*a* is displaced continuously frontward from its upper end toward its lower end.

A mount-and-release mechanism 15 to mount and release the battery 90 is installed on the rear face 13*a* of the rear portion 13. The mount-and-release mechanism 15 includes a guide member to which the battery 90 is fitted to extend longitudinally in the upper-lower direction and a support member (not shown) to support the battery 90 from below.

Figure 2:
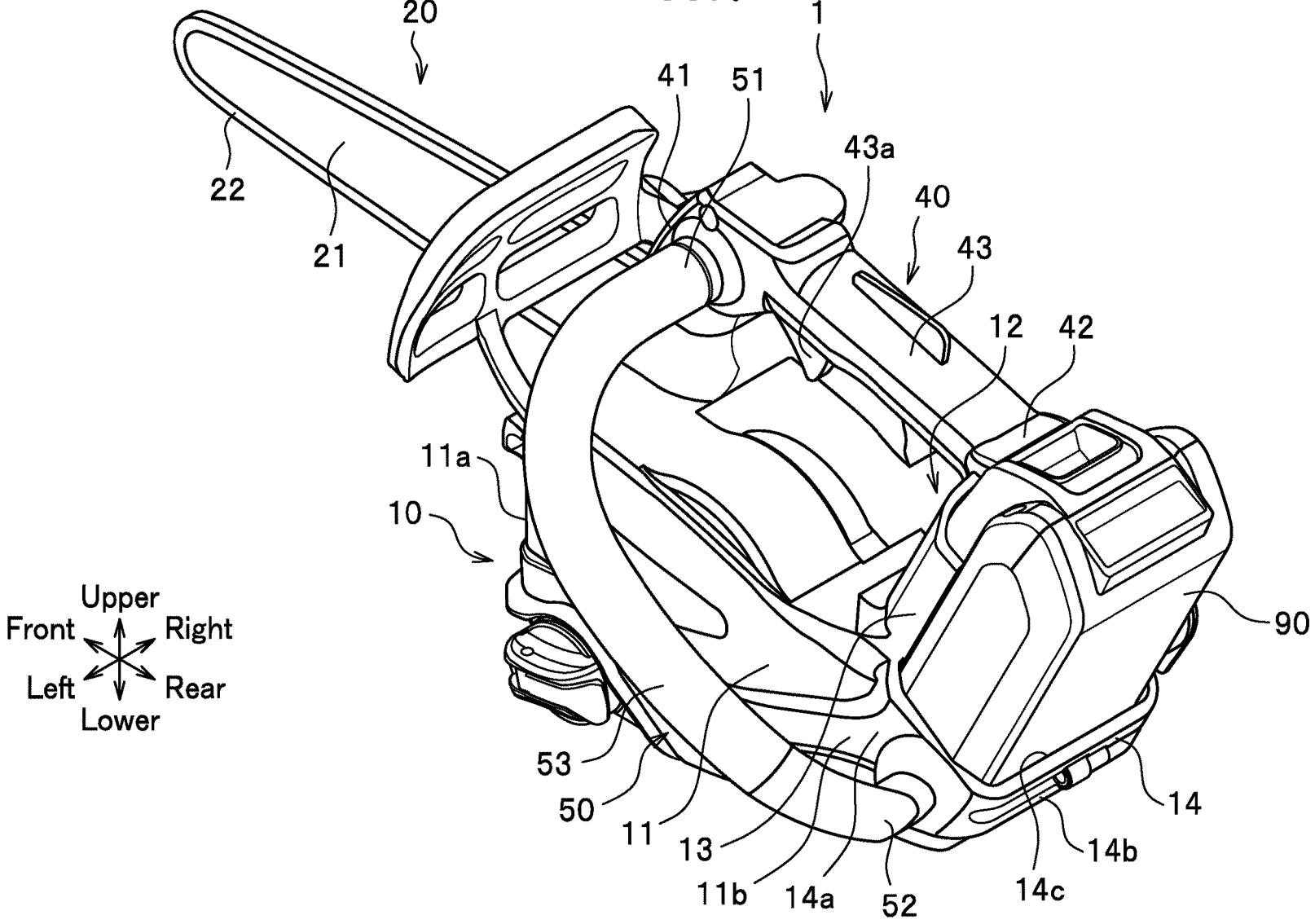
FIG. 2 is a perspective view of the chainsaw of the embodiment when viewed from upward, leftward and rearward.

When the battery 90 is mounted to the retaining portion 13, the battery 90 is made to slide downward along the mount-and-release mechanism 15 to be mounted to the retaining portion 13 as shown in FIG. 2.

The battery 90 is a known battery which includes such a rechargeable battery such as a lithium ion battery housed in a case that is in a rectangular parallelepiped shape and extends in the upper-lower direction as shown in FIG. 3.

The battery 90 has a height larger than a height of the rear portion 11*b* of the body portion 11, as seen in FIG. 1. The battery 90 of the present embodiment can be larger than one to be housed within the body case 10. The battery 90 has a sufficiently high output power and a sufficiently large charge capacity for operation.

When the battery 90 is mounted at the retaining portion 13, the battery 90 extends longitudinally in a height direction of the body case 10. The battery 90 mounted at the retaining portion 13 is formed to be larger than the rear portion 11*b* of the body portion 11 and extends upward from its lower end portion and across a middle portion H of the rear portion 11*b* of the body portion 11 in the height direction.

The battery 90 extends in the upper-lower direction and across in the rear portion 11*b* of the body portion 11 and is larger than the rear portion 11*b*.

The battery 90 mounted at the retaining portion 13 extends upward up to a position as high as or higher than a height HH that is higher than the middle position H by two thirds of a length between the middle portion H and an upper end 11*b*H of the rear portion 11*b*. In addition, an upper end of the battery 90 is higher than a top point of a rear end portion 42 of the top handle 40 and protrudes upward from a base line 45 extending in the extension direction of the top handle 40.

The battery 90 mounted at the retaining portion 13 extends downward to a position as low as or lower than a height HL that is lower than the middle position H by two thirds of a length between the middle portion H and a lower end 11*b*L of the rear portion 11*b*.

Furthermore, the retaining portion 13 has an ejection mechanism (not shown) installed to release the battery 90 from the battery mount-and-release portion 12. The battery 90 can be lifted off by operating a lever attached to an upper portion of the battery 90 with the battery 90 mounted at the retaining portion 13 to actuate the ejection mechanism.

There are connection terminals 16 made of metal that are attached on the rear face 13*a* of the retaining portion 13, as shown in FIG. 3. The connection terminals 16 are electrically connected with the control board and the motor 30 (see FIG. 1). When connection terminals of the battery 90 are connected with the connection terminals 16 of the retaining portion 13, electric power is capable to be supplied to the control board and the motor 30 from the battery 90.

The battery case 14 is formed at a lower end portion of the battery mount-and-release portion 12, as seen in FIG. 1. The battery case 14 receives a lower portion of the battery 90 disposed under the middle portion H of the rear portion 11*b* of the body portion 11 in the height direction.

The battery case 14 includes right and left side walls 14*a*, 14*a* and a rear end wall 14*b*, as shown in FIG. 3. The right and left side walls 14*a* extend rearward from the lower portion of the retaining portion 13. The rear end wall 14*b* extends from both the right and left side walls 14*a*, 14*a*. A space surrounded by the retaining portion 13, the right and left side walls 14*a*, 14*a* and the rear end wall 14*b* is a space in which the lower portion of the battery 90 is disposed.

At an upper end of the battery case 14 is formed an insertion opening 14*c* through which the battery 90 is inserted from upward. At a lower end of the battery case 14 is formed an opening portion 14*d* having an opening bored through in the upper-lower direction.

As shown in FIG. 1, when the lower portion of the battery 90 is inserted into the battery case 14 and the battery 90 is mounted at the retaining portion 13, a lower end portion of the battery 90 protrudes downward from the opening portion 14*d* (see FIG. 3).

The cutting attachment 20, which projects frontward, is attached to a right side portion of the body portion 11, as shown in FIG. 2. The cutting attachment 20 is a work tool for cutting operations and includes a guide bar 21 and a saw chain 22.

The guide bar 21 is a plate-like member extending in the front-rear direction and has a rear end portion that is fixed to the right side portion of the body portion 11.

The saw chain 22, which is a closed circular chain, is wound along the circumference of the guide bar 21. A rear end portion of the saw chain 22 engages with a drive gear secured to the output shaft of the motor 30.

When the motor 30 is driven to rotate the drive gear (not shown), the saw chain 22 rotates along the circumference of the guide bar 21.

As shown in FIG. 1, the top handle 40 is arranged and joined to an upper face of the body portion 11 and extends continuously in the front-rear direction over the body portion 11.

A front end portion 41 of the top handle 40 extends upward from a front end portion of the upper face of the body portion 11.

A rear end portion 42 of the top handle 40 is arranged and joined to the upper end portion of the retaining portion 13 of the battery mount-and-release portion 12. When the battery 90 is mounted at the retaining portion 13, the upper end portion of the battery 90 projects upward over a horizontal face on the upper end 11*b*H of the rear end portion 42 of the top handle 40.

An upper grip portion 43 extending in the front-rear direction is formed between the front end portion 41 of the top handle 40 and the rear end portion 42 of the top handle 40. The upper grip portion 43 extends in the front-rear direction inclining slightly downward from the front end portion 41 of the top handle 40 toward the rear end portion 42.

The upper grip portion 43 is a portion to be gripped by an operator to hold the chainsaw 1. The operator puts a hand between the upper grip portion 43 and the upper face of the body portion 11.

A trigger lever 43*a*, which is an operation means for an operator to increase and decrease a rotation speed of the saw chain 22 while gripping the upper grip portion 43, is installed on the upper grip portion 43, as shown in FIG. 2.

The side handle 50 extends in the front-rear direction from a front portion of a left side of the body case 10 to a rear portion of the body case 10. The side handle 50 is formed of a member in a cylindrical shape by bending the member.

A front end portion 51 of the side handle 50 is arranged and secured to an upper end portion of a front end portion 41 of the top handle 40. The front end portion 51 of the side handle 50 is positioned above the motor 30, as shown in FIG. 1.

A rear end portion 52 of the side handle 50 is positioned rearward of and below the output shaft 31 of the motor 30. The rear end portion 52 of the side handle 50 is positioned rearward of and below an outer circumference 30*a* of the motor 30. The rear end portion 52 of the side handle 50 is arranged and secured to a left side wall 14*a* of the battery case 14.

As shown in FIG. 2, an intermediate portion of the side handle 50 between the front end portion 51 of the side handle 50 and the rear end portion 52 of the side handle 50 is curved in such a way that the intermediate portion bulges outward from a left side face of the body case 10.

A side grip portion 53 is formed between the front end portion 51 of the side handle 50 and the rear end portion 52 of the side handle 50. The side grip portion 53 is a portion to be gripped by an operator to hold the chainsaw 1. The side grip portion 53 is disposed between the motor 30 and the battery mount-and-release portion 12 and on the left side of the body case 10 (See FIG. 2).

The side handle 50 has the rear end portion 52 disposed at a lower position than the front end portion 51. When the body case 10 is viewed from its left side, the side grip portion 53 is seen inclining gradually downward from the front end portion 51 toward the rear end portion 52. That is to say, when the body case 10 is viewed from its left side, the side grip portion 53 is seen extending diagonally straight downward from upward of the motor 30 toward downward of the motor 30.

The side handle 50 is disposed preferably in such a way that the side handle 50 is not seen overlapping with a centre portion (output shaft 31) of the motor 30 when the body case 10 is viewed from its left side. That is to say, the side handle 50 has such a shape that no part of the side handle 50 is disposed on a side of the middle portion (output shaft 31) of the motor 30. Since the side handle 50 of this configuration is seen extending more or less straight when the body case 10 is viewed from its left side, an operator can easily grip the side handle 50. The side handle 50 is disposed preferably in such a way that the side handle 50 is not seen overlapping with the whole motor 30 when the body case 10 is viewed from its left side.

When an object to be cut such as a tree and a wood plate is cut with the chainsaw 1 as shown in FIG. 1, an operator holds the chainsaw 1 by gripping the upper grip portion 43 of the top handle 40 with one hand while the other hand is gripping the side grip portion 53 of the side handle 50. The object to be cut can be cut with the saw chain 22 by operating the trigger lever 43*a* of the top handle 40 to rotate the saw chain 22.

As shown in FIG. 1, the chainsaw 1 as described above comprises the body case 10, the cutting attachment 20 (work tool) projecting out of the front portion of the body case 10, the motor 30 to drive the cutting attachment 20 and the battery 90 to supply electric power to the motor 30.

The motor 30 is housed in the front portion 11*a* of the body case 10 while the battery mount-and-release portion 12, on which the battery 90 is mounted and from which the battery 90 is released, is formed on the rear portion 11*b* of the body case 10. The battery 90 mounted on the battery mount-and-release portion 12 extends in the upper-lower direction in the height direction of the rear portion 11*b* of the body case 10 and across the middle portion H.

The side handle 50 is arranged and secured to the left side face of the body case 10. The side handle 50 extends from the front portion 11*a* of the body case 10 to the rear portion 11*b* of the body case 10. Preferably, the side handle 50 extends to the rear portion 11*b* in such a way that the rear end portion 52 of the side handle 50 is disposed rearward of and below the output shaft 31 when the body case is viewed from its left side.

The chainsaw 1 has the motor 30 and the cutting attachment 20 both disposed at the front portion 11*a* of the body case 10 and the relatively large battery 90 mounted at the rear portion 11*b* of the body case 10. The side handle 50 extends rearward of the output shaft 31 of the motor 30.

The chainsaw 1 of this configuration has a weight well balanced in the front-rear direction with the side handle 50 being gripped, even if the battery 90 that is relatively large is mounted at the rear portion 11*b* of the body case 10. In addition, the battery 90 is supported while the side handle 50 is gripped by an operator with arms bent at an angle that is suited for gripping the side handle 50. As a result, the operator can hold the chainsaw 1 easily during work.

Even when the chainsaw 1 is operated with arms stretched, the operation is performed with a rear portion of the side handle 50 being gripped to support the battery 90 that is relatively large and then an operator can easily hold the chainsaw 1 during work, which contributes to enhancing work efficiency.

Preferably, the side handle 50 extends rearward of the outer circumference 30*a* of the motor 30. In this case, the side handle 50 is best suited for holding the chainsaw 1 and the same effect as mentioned above is obtained.

Since a chainsaw having a top handle has usually a cutting attachment (guide bar) that is relatively short in the front-rear direction, this type of the chainsaw has a length shorter in the front-rear direction and a centre of gravity positioned more rearward, in comparison with a chainsaw with a rear handle (not shown), which makes mounting a large battery difficult. However, the chainsaw 1 of the present embodiment has a weight better balanced in the front-rear direction even when the relatively large battery 90 is mounted, which contributes to increasing the work efficiency.

Since the chainsaw 1 has the side grip portion 53 of the side handle 50 disposed between the motor 30 and the battery mount-and-release portion 12, an operator can grip the side handle 50 between the motor 30 and the battery 90 stably.

The chainsaw 1 has the front end portion 51 of the side handle 50 positioned above the motor 30 and the rear end portion 52 of the side handle 50 positioned below the front end portion 51. Since the side handle 50 extends diagonally downward from upward of the motor 30 to rearward of the motor 30, an operator can easily grip the side handle 50 from above.

As shown in FIG. 3, the chainsaw 1 has the battery case 14 formed on the battery mount-and-release portion 12. The battery case 14 surrounds at least two faces 90*a*, 90*b* which extend in the upper-lower direction, preferably at least three faces 90*a*, 90*b*, 90*c*, or more preferably four faces 90*a*, 90*b*,

90*c*, 90*d*. The rear end portion 52 of the side handle 50 is arranged and secured to the side face of the battery case 14.

Compared with the conventional chainsaw, the chainsaw 1 has the side handle 50 having a longer length and extending diagonally in the front-rear direction inclining downward toward the rear end portion 52 while the body case 10 is made smaller. As a result, the chainsaw 1 is capable of supporting the battery 90 that is larger with the side handle 50 gripped with an arm bent at angle that is suited for gripping. The battery 90 that is relatively large can be supported by gripping the side handle 50 disposed close to the battery 90. Therefore, the chainsaw 1 is held easily during work, which contributes to increasing the work efficiency.

As shown in FIG. 1, the top handle 40, which extends in the front-rear direction, is formed on the upper portion of the body case 10 of the chainsaw 1 and has the rear end portion 42 arranged and joined to the upper portion of the battery mount-and-release portion 12. The battery mount-and-release portion 12 inclines in such a way that a lower portion of the battery mount-and-release portion 12 is positioned frontward of an upper portion of the battery mount-and-release portion 12.

Since the upper portion of the battery mount-and-release portion 12 is positioned rearward of the lower portion of the battery mount-and-release portion 12, the top handle 40 can be made longer in the front-rear direction. In addition, a space between the upper face of the body portion 11 and the top handle 40 can be made larger.

Moreover, the battery 90 mounted on the battery mount-and-release portion 12 has an upper portion and a lower portion positioned frontward of the upper portion. Therefore, while the top handle 40 is easily gripped, the chainsaw 1 has a centre of gravity closer to a centre of the body case 10 and a better weight balance when an operator grips the top handle 40, and the chainsaw 1 is operated efficiently during work.

Furthermore, since the lower portion of the battery 90 mounted on the battery mount-and-release portion 12 is positioned frontward of the upper portion of the battery 90 and the side handle 50 extends toward the battery 90, the side handle 50 can be gripped with an arm bent at an angle that is suited for gripping and operation is performed with a portion of the side handle 50 closer to the battery 90 being gripped. In addition, since the lower portion of the battery 90 is positioned frontward of the upper portion of the battery 90, the chainsaw 1 can be smaller in the front-rear direction.

The battery 90 of the chainsaw 1 mounted on the battery mount-and-release portion 12 extends longitudinally in the height direction of the body case 10.

The chainsaw 1 of this configuration has a centre of gravity shifted more frontward than a chainsaw having the battery disposed to have a longitudinal direction more or less in the front-rear direction, even when the battery 90 enlarged in the height direction is mounted. As a result, the chainsaw 1 with a large battery 90 mounted thereto is held easily during work while the chainsaw 1 can be made smaller.

The battery 90 mounted on the battery mount-and-release portion 12 of the chainsaw 1 has an upper portion extending to be higher than a top point of the rear end portion 42 of the top handle 40, projecting over a base line 45 extending in the extension direction of the top handle 40 and preferably projecting upward over a horizontal face on an upper end 11*b*H of the rear end portion 42 of the top handle 40.

Since the chainsaw 1 has the battery 90 inclining in such a way that the upper portion of the battery 90 is spaced rearward apart from the upper grip portion 43, the battery 90 is not in the way of operation when an operator grips the upper grip portion 43 even if the battery 90 becomes longer in the upper-lower direction. Accordingly, the chainsaw 1 can have the battery 90 that is larger mounted thereto without compromising operation during work.

The chainsaw 1 has the battery case 14 formed on the battery mount-and-release portion 12, as seen in FIG. 3. An insertion opening 14*c*, through which the battery 90 is inserted from upward, is formed at the upper end portion of the battery case 14 and an opening portion 14*d* is formed at the lower end portion of the battery case 14.

If foreign material such as dust or water comes into the battery case 14 of the chainsaw 1 of this configuration, it is discharged through the opening portion 14*d*. In addition, when the battery 90 is mounted onto the battery mount-and-release portion 12, it is easy to mount the battery 90 on the battery mount-and-release portion 12 because the battery 90 is directed downward toward the battery case 14.

Though an embodiment of the present invention has been explained as above, the present invention should not be limited to this embodiment and can be modified to various other embodiments and modifications within a scope of the invention.

Although the side handle 50 of the present embodiment extends straight as seen in FIG. 1, when the chainsaw 1 is viewed from the left side, the shape of the side handle is not limited to this configuration. For example, the side handle 50 may be in such a shape that it is seen bent when the body case 10 is viewed from the left side.

The chainsaw 1 of the present embodiment has the battery case 14 formed on the battery mount-and-release portion 12. However, the chainsaw 1 may do without the battery case 14. In this case, the rear end portion 52 of the side handle can be joined to a lower portion of the retaining portion 13.

Though the present embodiment describes the chainsaw 1 to which the present invention is applied, the electric-power-driven working device is not limited and can be applied to various electric-power-driven working devices such as a portable mowing machine, a hedge trimmer and a blower.

The invention claimed is:

1. An electric-power-driven working device comprising:

a body case;

a saw chain projecting frontward out of a front portion of the body case; a motor driving the saw chain; and a battery for supplying electric power to the motor, wherein the front portion of the body case houses the motor while a battery mount-and-release portion, into which the battery is mounted and from which the battery is released, is formed at a rear portion of the body case, wherein the battery mount-and-release portion includes a retaining portion to retain the battery and a battery case in which the battery is housed, the battery case including right and left side walls extending to protrude rearward respectively from right side and left side lower portions of the retaining portion and a rear end wall extending between rear end portions of the right and left side wall, and the battery mounted in the battery mount-and-release portion extends in an upper-lower direction and across a middle portion in a height direction of the rear portion of the body case, and wherein a side handle is arranged to a side face of the body case, extends from the front portion of the body case to the rear portion of the body case and includes a rear end portion that is disposed rearward of and below an output shaft of the motor and attached to a side of the battery case.

2. The electric-power-driven working device as described in claim 1, wherein the battery mounted on the battery mount-and-release portion extends longitudinally in a height direction of the body case.

3. The electric-power-driven working device as described in claim 1, wherein the side handle includes a grip portion disposed between the motor and the battery mount-and-release portion.

4. The electric-power-driven working device as described in claim 1, wherein a top handle extending in a front-rear direction is formed on an upper portion of the body case and includes a rear end portion arranged to an upper portion of the battery mount-and-release portion, and wherein the battery mount-and-release portion inclines in a way that a lower portion of the battery mount-and-release portion is disposed frontward of the upper portion of the battery mount-and-release portion.

5. The electric-power-driven working device as described in claim 4, wherein an upper portion of the battery projects upward over a horizontal face including an upper end of a rear end portion of the top handle.

6. The electric-power-driven working device as described in claim 1, wherein an opening portion is formed at a lower end portion of the battery case, having an opening that is bored through in the up-down direction, and wherein a lower portion of the battery protrudes downward from the opening portion of the battery case, when the battery is mounted on the retaining portion.

* * * * *